US005182909A

United States Patent [19]

Stellwagen

[11] Patent Number: 5,182,909

[45] Date of Patent: Feb. 2, 1993

[54] VALVE SYSTEM FOR LOAD-INDEPENDENT HYDRAULIC CONTROL OF A PLURALITY OF HYDRAULIC CONSUMERS

[75] Inventor: Armin Stellwagen, Lohr, Fed. Rep. of Germany

[73] Assignee: Mannesmann Rexroth GmbH, Lohr/Main, Fed. Rep. of Germany

[21] Appl. No.: 743,130

[22] Filed: Aug. 9, 1991

[30] Foreign Application Priority Data

Aug. 27, 1990 [DE] Fed. Rep. of Germany ..... 4027047

[51] Int. Cl.[5] ..... F15B 13/06; F15B 11/16; F15B 11/02

[52] U.S. Cl. ..... 60/426; 60/427; 91/517; 91/518

[58] Field of Search ..... 60/426, 427; 91/517, 91/518

[56] References Cited

U.S. PATENT DOCUMENTS 4,739,617 4/1988 Kreth et al. ..... 60/427 X

FOREIGN PATENT DOCUMENTS 0079870 5/1983 European Pat. Off. .
8414265 8/1984 Fed. Rep. of Germany .
3414793 10/1984 Fed. Rep. of Germany .
3428403 4/1985 Fed. Rep. of Germany .
3634728 4/1988 Fed. Rep. of Germany .

*Primary Examiner*—Gerald A. Michalsky

*Attorney, Agent, or Firm*—McAulay Fisher Nissen Goldberg & Kiel

[57] ABSTRACT

A valve system is provided for the load-independent control of a plurality of simultaneously operated hydraulic consumers, i.e. regardless of variations in load pressure. Fluid flow in a consumer line to each consumer passes across a compensating flow control valve, i.e. a compensator. The valve piston thereof being displaceable to the open position by a pressure downstream of a flowmeter against the opposing resistance offered by a spring and by the respective maximum load pressure of the consumers at a time. The actual highest load pressure is also available at a regulator for the common variable displacement supply pump feeding the consumers. In an attempt to ease actuation of the main valves, yet offering the capability to serve different functional requirements by slightly modifying the circuitry and to ensure that insufficient fluid supply from the pump does not exclusively affect the consumer actually subject to the maximum load, the compensator and flowmeter are arranged in a secondary flow path carrying only a fraction of the total consumer fluid supply. The main volume flow rate is regulated by the control edge of greater cross section which moves together with the pressure sensitive displacements of the compensator spool. The control edge is supplied by a valve means capable of reducing fluid pressure in a primary supply line to the pressure level downstream of the flowmeter.

17 Claims, 7 Drawing Sheets

$Q_{31} = Q_{11} + Q_{21}$ $Q = Q_1 + Q_2$

VALVE SYSTEM FOR LOAD-INDEPENDENT HYDRAULIC CONTROL OF A PLURALITY OF HYDRAULIC CONSUMERS

BACKGROUND OF THE INVENTION a) Field of the Invention

The invention relates to a valve system for load-independently controlling a plurality of simultaneously operated hydraulic consumers or actuators (under any condition of load), as defined in the classifying portion of claim 1.

b) Background Art

A valve system of this type is disclosed in DE 36 34 728 A1 and is used to keep the volume flow rate to the actuator constant regardless of variations in load conditions. The feed lines which connect each actuator to a common pump supply have inserted or incorporated a directional valve, i.e. a way-valve for directional and speed control,and downstream of such valve also a throttling valve whose piston is acted upon to the closing position by the peak load pressure, i.e. the respective highest load pressure in any one of the actuated consumers and by a spring and in the reverse direction by fluid pressure exerted downstream of the way-valve or directional valve.

The instantaneous maximum load or load pressure of any one of the plurality of actuated consumers at a time is sensed by a common line, called load sensing line, and is transmitted to a regulating device of the variable displacement pump, i.e. a pump having a variable displacement capability to react to changes in fluid demand. With this particular arrangement it is possible to keep the pressure difference across the way valve orifice functioning as a metering throttle constant regardless of variations in load pressure and to simultaneously ensure that the respective fluid flows to each one of the actuated consumers under varying load conditions are kept at a constant ratio or proportion. The way-valve or directional valve is thus acting as a fluid metering device. In the described valve arrangement the ratio of the regulated fluid flows is even maintained constant if peak demands cannot be supplied, i.e. if the volume flow rate is insufficient to feed all actuators. In this case all partial flow rates to the individual actuators are reduced in proportion to the fixed ratio.

The circuitry of this known valve arrangement is shown in the schematic of FIG. 1, to which reference will be made in the following. The variable volume displacement pump which picks up fluid from a reservoir T is referenced with numeral 1. The pump is controlled by a pump regulator 12 in order to regulate the pump discharge in dependance of fluid pressure in a load sensing line LS. The consumer feed line is referenced 7, it being understood that each actuator is connected to a branched-off feed line $7_1$ to 7x. In FIG. 1 only one actuator is depicted by the dash-dotted box V. Each one of the branched-off feed lines incorporates in sequence a flowmeter 6 and a so-called compensator 3 in the form of a compensated flow control valve, i.e. a 2-directional flow regulating valve having a metering or control edge 4. To bias the valve or the regulating spool into the closing direction, a spring 13 plus the actual load pressure in a load sensing line 10 act in closing direction while in the reverse direction fluid pressure in the feed line 9 downstream of flowmeter 6 acts to open up the valve.

The known valve system uses elements of equal nominal size or caliber thus rendering the control of the individual pilot valves or flowmeters rather complex. In addition the known arrangement renders it difficult to adjust the system on demand to special functions of the control circuit or block without being forced to replace the pistons in the various valves.

In order to adjust the volume flow rate across valves with smaller sized or calibered pistons German OS 34 28 403 proposes a valve arrangement in which the way-valve or directional valve in the form of a flowmeter is designed as a two-stage controlled orifice valve acting as a flow amplifier. Again each actuator is associated with a compensator which is biased at one end by fluid pressure in the supply line downstream of the directional valve or pilot valve and at the other end by a spring and by the pressure at the respective consumer or actuator.

In this type of flow regulator or regulating control valve the pressure drop at the metering throttle is determined by the setting of the pressure compensator spring. When operating a plurality of consumers in parallel and assuming that in this case the demanded volume flow rate exceeds the feed capacity of the pump the respective consumer which is subject to the highest load pressure will be discriminated in favour of the other actuators operating at lower load pressure, respectively. In practice, fluid flow to the actuator with the highest load pressure will gradually decrease thus slowing down actuator motion until stopping occurs. Accordingly, the system does not provide for reducing fluid flow in equal proportion in the event of lack of fluid supply to the actuators. A further disadvantage of the known arrangement is the need to use a large-caliber spool in the main stage of the directional valve and in the compensator. Because both the directional valve main stage and the pilot valve stage use 4-way, 3 position spools, also in this case special functions of the control circuit can only be accomplished by changing the spools.

To provide greater flexibility with respect to the control functions of the control circuit, European Patent 0 079 870 B1 discloses a valve system in a so-called "detached construction". The compensator in this case is a small-sized or small-calibervalve. The compensator holds a secondary fluid flow constant which also passes through a small-sized flowmeter which is also of small-caliber. However, as the pressure difference or pressure drop across the flowmeter orifice is also determined by the setting of a spring that acts in opening direction of the compensator, and provided all consumers are operated in parallel and instantaneous pump supply is deficient, the consumer subject to the respective highest load pressure will be discriminated.

An object of the invention is to improve a valve system for the purposes described by employing an arrangement capable of performing special functions without requiring expensive spool replacements, yet simplifying operation of the main valves which regulate the fluid flow to the consumer while at the same time ensuring that the consumer subject to maximum load in the event of parallel operation of several consumers and insuffient pump supply will not be discriminated.

According to the invention this object is attained by a valve system for controlling a plurality of simultaneously actuated by hydraulic consumers or actuators, in which each consumer feed line is connected across a compensating flow control valve or compensator to be opened by displacing the spool under the action of fluid pressure downstream of a flow meter against the opposing resistance offered by a spring and the actual maximum or highest load pressure of the consumer. The highest load pressure is simultaneously transmitted to a regulating device of a variable displacement pump which supplies the consumers. The compensator and the flow meter are inserted in a secondary feed line which carries a fraction of the fluid flow feed to the consumer. The fluid flow feed is regulated by a metering edge of larger cross section and adapted to participate in the control movements of the compensator. The metering edge is supplied by valve means capable of reducing the fluid pressure in the main feed line to the pressure level downstream of the flow meter.

According to the invention, the control edge or orifice, respectively, of the valve is associated with an amplifying stage which constitutes the sole large-sized or large-caliber element in the hydraulic circuitry through which fluid passes on actuation of a consumer. Since only a partial flow is directed across the adjustable flowmeter or throttle and the control orifice, these elements can be designed as pilot control elements with small caliber. By setting a fixed ratio, for example 10:1, for the control orifice areas provided at the control edge on one end and at the amplifying stage on the other end, in the line upstream of the metering edge and the amplifying stage the volume flow rate passing through the main line is higher in proportion to the fixed orifice area, provided that fluid pressures in these lines are equal. Downstream of the metering edge or the control orifice of the amplifying stage both partial flows may merge to make up a regulated total volume flow rate. Because the larger control orifice is supplied by a valve capable of reducing pressure in the main line to the fluid pressure downstream of the flowmeter, with a constant relationship between the areas of the control edge and of the metering orifice of the amplifier the resultant transmission ratio at the compensator or at the adjustable flow control valve will be constant, because an equal fluid pressure is held up upstream of the compensator both in the main line and in the secondary line. For the many individual consumers to be supplied only a single pressure reducing valve in the main line is required, whereby the complexity of the system can be minimized. By indirectly adjusting a relatively high volume flow rate using a valve, i.e. an adjustable small-sized or small-caliber flowmeter, it will be possible to actuate the valve of large orifice area not only by hydraulically operating means, but also by mechanical, electrical, electro-hydraulical or pneumatical means. For example, the actuating force to control the flowmeter or a respective pilot valve, respectively may thus be supplied by directly working electrical devices such as solenoids or the like.

By dividing the volume flow rate to be regulated into a main and a secondary flow path additional control functions of the valve arrangement or of the control circuit incorporating the present valve system, pressure limites functions, deceleration valve functions and functions for preventing cavitation at low pressure operation of the consumers in a deceleration mode may be accomplished with valves of small piston area. This offers the special advantage of designing the valve system as a so-called "detached system" which eliminates the need of troublesome piston replacement in order to comply with the above mentioned auxiliary functions. For example, all way-functions of a 4-way valve may be controlled singly or in unison thus providing routing connections that would otherwise only be possible by changing the large-sized valve pistons.

The valve means that reduces the fluid pressure in the main feed line to the pressure downstream of the flowmeter is advantageously selected from pressure reducing valves. Because fluid pressure in the bypassed or secondary line downstream of the flowmeter in the balanced state of the compensator is equal to the maximum load pressure in the system plus a small amount necessary to open up the compensator as determined by the spring setting, the same rise in pressure must be available or assured at the pressure reducing valve. This is accomplished by appropriately matching the compression spring to the closing spring of the compensator.

The inventive concept to regulate the primary fluid supply regardless of load pressure variations, i.e. load-independently by means of the regulating motions of a compensator which is interposed in a secondary or bypass line, may also be useful when employed in the return line of a consumer. With such a valve arrangement the return side of a consumer may be controlled in a similar manner regardless of the load pressure, i.e. load-independently. In this instance, too, the control orifices are rigidly connected with one another, the ratio between the respectively control edge areas being predetermined. The previously described advantages in circuit design with respect to the provision of special functions as required by the control circuit equally apply to the return side of a consumer.

One improvement employs simple means to prevent a load from falling. When the pilot valve is not actuated or working, due to the throttle valve pressure build-up in the main return line as well as in the secondary return line is ensured thus acting to displace the compensator piston to the closing position.

Further improvements are incorporated in the valve system especially aimed at providing added auxiliary functions, yet protecting the valve system when operating the consumers at low fluid pressure, which would render the control system liable to cavitation.

The circuitry ensures that for lowering the consumer a drain port in the piston of the deceleration valve begins only to open when the pressure at the inlet increases sufficiently to move the spool against the force exerted by the spring and the pressure in the return line. Apart from the effect of lowering the load on the consumer regardless of variations in load pressure, it is additionally prevented that a lack of fluid supply to the consumer line is caused due to the fact that by acting of a heavy load on the consumer a greater amount of fluid would be dumped to the reservoir than is supplied to the consumer.

The deceleration valve is advantageously designed as a 2-way, 2 position proportional valve and thus contributes to minimize circuit complexity.

A further advantageous embodiment provides for controlling the return flow rate regardless of variations in load pressure. This version differs from the return fluid control in another embodiment by providing an additional small-sized or small-caliber pressure limiting valve which is actuated against the force of a closing spring by the pressure in the bypass-line downstream said fixed orifice restriction. If in this case the consumer load in the actuator or consumer feed line exceeds the pressure limit set by the rating of the spring of the pressure limiting valve, this valve opens to dump fluid from the actuator feed line through the fixed orifice restrictor to the reservoir. Consequently the pressures at the piston of the 2-way, 2 position valve interposed in the return line change and the resulting pressure imbalance will cause the valve to open, thus bleeding excess fluid in the actuator feed line back to the reservoir return.

One modification ensures through uncomplicated changes in the circuitry that the 2-way, position valve also opens when the force of the fluid in the return line exceeds the fluid pressure in the consumer feed line by an amount corresponding to the setting of the spring. In this way it is possible to ensure a repleneshing or make-up fluid supply function that helps to protect the valve system against cavitation.

Useful improvements of the valve system assure reliability in load sensing. One modification offers the particular advantage that the amount of fluid necessary to replenish both the load sensing line which is connected to the pump and the compensators at the moment of actual load sensing will be supplied by the pump and not by the load, thus effectively preventing a load from falling during the lifting cycle.

Yet another measure to supply make-up fluid to the load sensing line connected to the pump from the actuator or consumer feed line is provided by the invention.

For a better understanding of the present invention, reference is made to the following description and accompanying drawings while the scope of the invention will be pointed out in the appended claims.

DETAILED DESCRIPTION OF THE INVENTION

Figure 1:
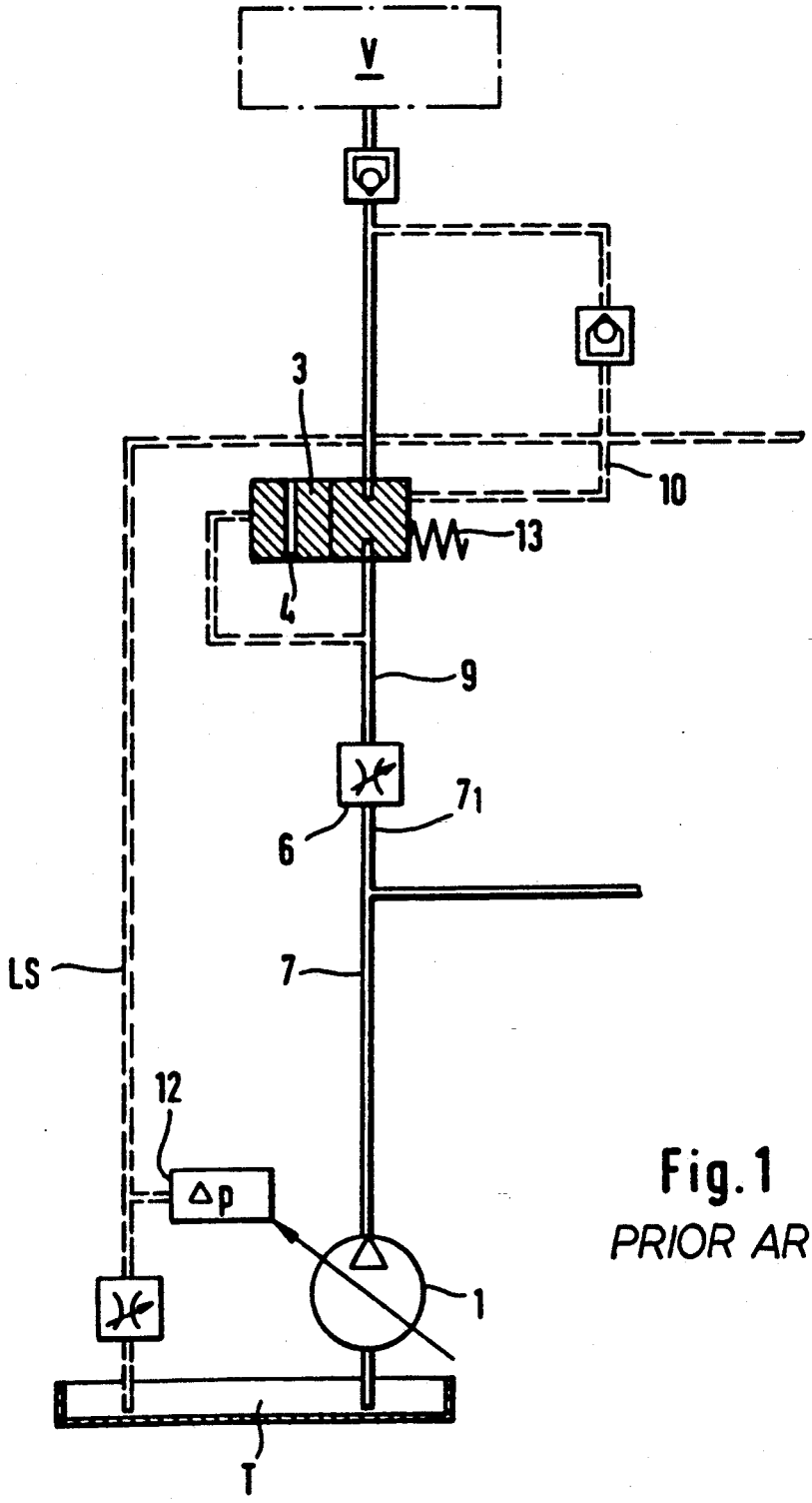
Fig. 1 PRIOR ART
FIG. 1 is a block diagram illustrating a common type of valve system for controlling a plurality of simultaneously actuated hydraulic actuators or consumers regardless of the condition of loading, i.e. load-independently.

For the purpose of clarity and ease of description like reference numerals designate like parts performing the same function throughout the description.

Figure 2:
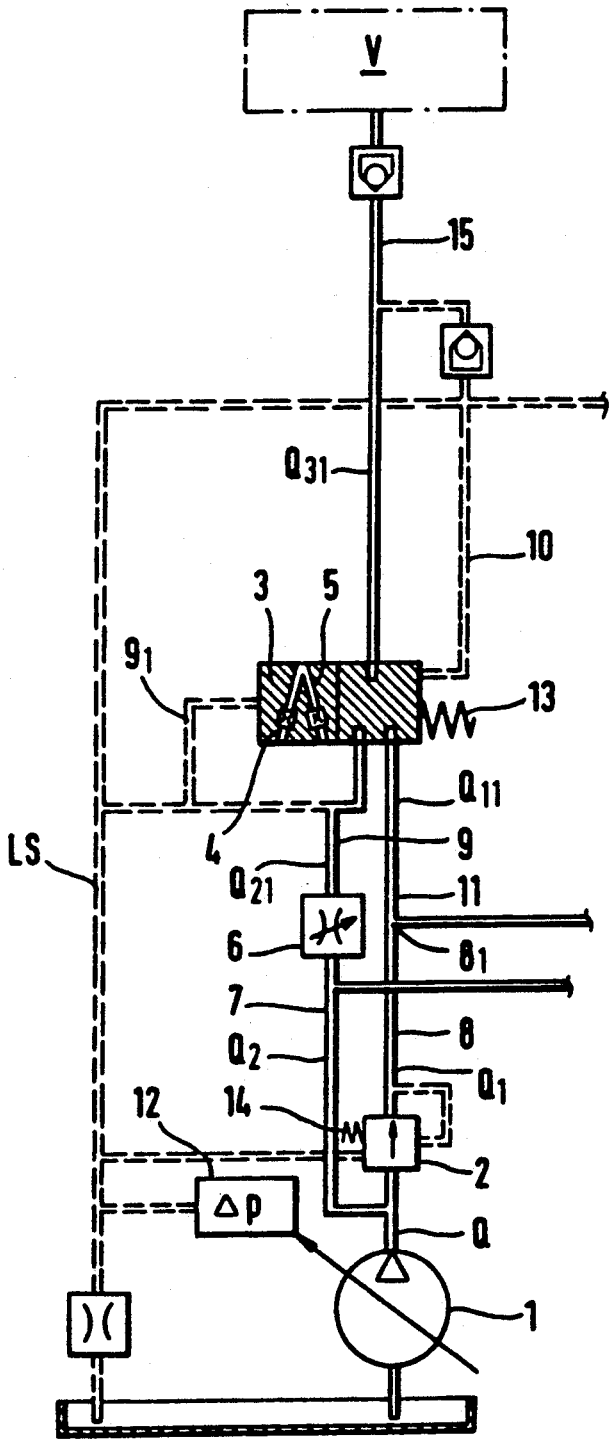
FIG. 2 a similar representation of FIG. 1 illustrating a portion of the block diagram of the valve system incorporating a first embodiment of the invention.

The first embodiment of the invention in FIG. 2 again comprises a variable displacement pump 1 with volume flow rate adjustment by means of a regulator 12. The regulator is controlled by a load sensing line LS adapted to transmit load pressure in supply line 15 of the consumer or actuator. Fluid flow $Q_{31}$ supplied to the actuator is composed of a primary fluid supply $Q_{11}$ and a secondary or by-passed supply $Q_{21}$. Both the pump supply Q1 passing through a pump supply line 8 and the by-passed fluid Q2 flowing through a supply line 7 lead to and are connected to a pressure compensating device 3, hereinafter termed compensator. The flow division shown in FIG. 2 is identical for each actuator or consumer so that for the sake of clarity the supply of only one of the actuators is shown. The main pump supply line 8 is branched off at $8_1$ to form a branch passage 11 which is connected to a port of the compensator 3. In the same manner the supply line 7 is branched off (passage 9) and coupled to a further port of the compensator 3.

The secondary fluid branches 7, 9 incorporate an adjustable flow control valve 6 to meter out and control the fluid volume flow rate to the actuator.

The control edge of the compensator 3 is designated by numeral 4. A further metering edge or metering orifice 5 arranged in parallel thereto functions as a hydraulic amplifying stage. The ration of the two orifice cross sections 4 and 5 is advantageously selected to be 1:10. At the opposite end of the pressure compensator 3 the fluid pressure in supply line 9 via a control line $9_1$ acts against the force of spring 13 and the fluid force applied via line 10. Accordingly the adjustable flowmeter 6 and control edge 4 of the compensator cooperate to keep a partial flow rate constant. Due to the constant ratio of the orifice cross section of both control and metering edges, with equal pressures a volume flow passing through line 11 results which is in proportion to this ratio and which is regulated by the control displacements of the compensator via the larger-sized metering edge 5. The two volume flows Q11 and Q21 join each other downstream of the control orifices 4 and 5 thus delivering a regulated total volume flow rate $Q_{31}$. To achieve this, in addition to a constant ratio of the cross sectional area also the pressures in line 9 and 11 must be equal. In order to ensure that the same pressure drop across the flowmeter 6 inserted in supply line 9 also occurs in branch circuit 11, which feeds the primary fluid flow, a pressure reducing means of valve 2 is inserted in the pump supply line. This valve is used to reduce the pressure controlled by the regulator 12 in a pressure supply line 8 to a level equal to the pressure in supply line 9. The piston of the pressure reducing valve 2 is acted upon by the spring and the fluid pressure in the load sensing line LS as well as by the instantaneous controlled fluid pressure in main pump supply line 8.

Because fluid pressure in supply line 9 in the balanced state of the compensator 3 is equal to the maximum system load pressure plus a small amount necessary to overcome the force of spring 13 in order to open the compensator 3, the rating of compression spring 14 of the pressure reducing valve must be matched to that of spring 13, so as to ensure that the pressure increase by spring 13 causes spring 14 to apply the equivalent pressure increase at the pressure reducing valve 2.

By arranging the valves in this manner, it is possible to adjust a relatively large total volume flow rate, yet using a small-sized or small-caliber valve which in this case is the pilot valve 6 or flowmeter. In addition to operating the valves hydraulically, this offers the possibility of employing mechanical, electrical, electro-hydraulical or pneumatical means to actuate a valve of large caliber, which in this case is the primary orifice 5 (metering edge) of the compensator 3. Directly acting electromagnets to control the metering valve or an equivalent pilot valve can thus be used.

With the valve arrangement of the invention the maximum fluid supply to the actuator port is determined by appropriately selecting the size of the pilot piston in flowmeter 6 and by the transmission ratio at the compensator 3. As the fluid supply curve is exclusively determined by the choice of the piston of the pilot valve. Since through this flowmeter only a small secondary flow volume rate is led, in this area a small-sized valve will suffice. If the functional characteristics of the control block for several consumers have to be modified the larger-caliber or larger-sized components need not be altered thus yielding to greater flexibility of the valve system and rendering it suitable for a wider range of applications.

By dividing the flow path of the total volume flow to a primary and a secondary or by-passed passage as well as by implementing the directional control functions through 2-way functions of 2-position valves, a so-called "detached" valve arrangement is achieved. The normally possible directional control function of a 4-way, 3 position directional valve piston can be multiplied by using a 4-way valve in "detached" arrangement. This offers the possibility to control all directional functions of e.g. a 4-way valve singly or in unison thus creating flow passages that could otherwise only be accomplished by replacing the valve piston.

When parallelly operating a plurality of consumers, the interconnection of the various components according to the invention furtheron ensures that in the event that with different load conditions system demand exceeds the delivery of the pump 1, the preset partial volume flow rates can be reduced at a constant ratio with respect to each other.

By the fact that according to the invention the nominal width or caliber of the pilot valve 6 considerably reduced as compared with the nominal width value of metering edge 5, the pilot valve may conveniently be located inside the cap of the control block where it is easily accessible, thus adding to simplicity of construction of the block. In addition, replacement of the piston is facilitated.

In the following with reference to FIG. 3 an alternative embodiment of the invention will be described. This embodiment differs from that of FIG. 2 essentially by the provision of special means for lowering on a single acting actuator or consumer and in that a different kind of leading the load pressure signal to the variable displacement pump 1 is realized. A single-acting hydraulic motor referenced 100 is supplied with fluid from the supply line 15. The return line is referenced 17 In dash-dot lines there is shown the supply circuit 101 and the return circuit 102. The supply circuit insofar as it relates to the fluid supply of the consumer 100 substantially does not differ from the embodiment of FIG. 2. For reasons of simplifying the specification, a detailed description thereof is therefore omitted. The return circuit 102 includes means for lowering the consumer load regardless of the condition of loading, i.e. load-independently. To achieve this, the return line 17 piped to the reservoir line 48 includes a 2-way, 2-position valve 30 to be shifted between a closed and an open position. The main piston of 2/2-directional valve 30 is tensioned into the closed position by a spring 27 and is further biased by fluid pressure in a bypass line 17, downstream of a restrictor 39 and upstream of a pilot valve 28. The line $17_1$ bypasses the 2-way, 2-position valve and the fixed orifice restrictor 39 is mounted upstream of the pilot valve 2B.

Upon operation of the pilot valve 28, a predetermined volume flow rate passes through bypass line $17_1$ to the reservoir line 46. With the pilot drain valve 28 open and due to the action of the restrictor 39, a pressure imbalance is created on both control sides of the 2-way, 2-position valve, this imbalance causing the piston of the 2-way, 2-position valve 30 to move towards the open position. As a result the load at the consumer 100 can be lowered.

Figure 3:
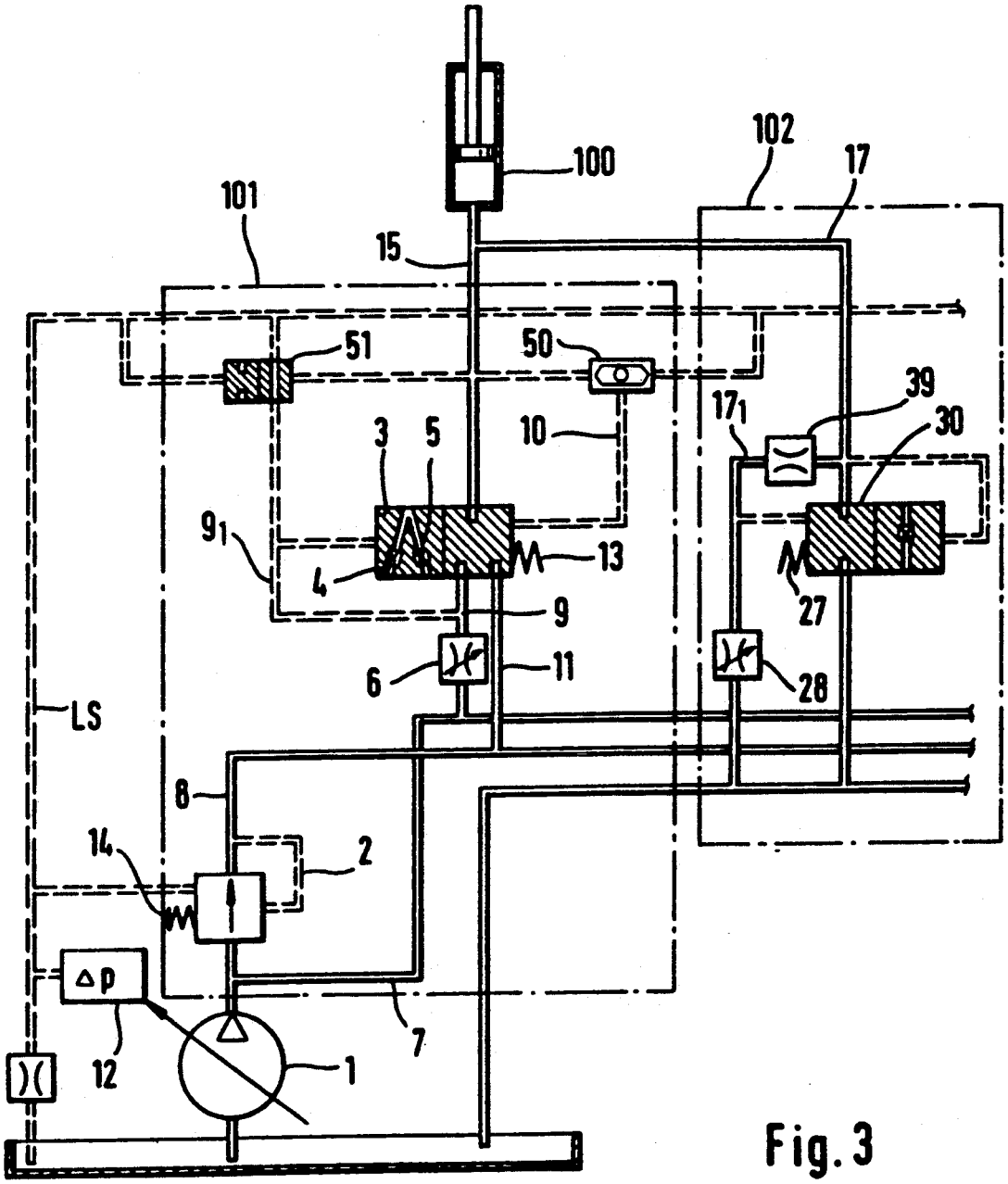
FIG. 3 shows a block diagram of a second embodiment of the valve system according to the invention which comprises additional components for reducing pressure of a single-acting consumer.

To physically accomplish the load sensing action in the embodiment of FIG. 3, the fluid volume to supply or fill the load sensing line LS is being derived from the pump supply line 7, 9 so as to effectively prevent an unintentional load lowering or drop. To this end a pressure sensing valve 51 is inserted between circuit line $9_1$ and the LS-line connected to the pump regulator 12. Valve 51 is a continuously displaceable 2-way, 2-position valve, in short a 2/2-directional valve. In the position shown in FIG. 3 the valve opens up to connect line $9_1$ to the LS-line. In the other switching position, the connection is interrupted. The piston of the pressure sensing valve 51 is being acted upon on the one side by fluid pressure in the load sensing line LS and on the other side by the load pressure in supply line 15 acting at the actuator. If the pressure $P_{15}$ in the said supply line 15 upstream the consumer exceeds the pressure in the load sensing line LS that is piped to the pump, the piston of the load sensing valve 51 is displaced to open the valve, thus transmitting the pressure $P_9$ in the supply line section 9 via line $9_1$ to the load sensing line LS and via a shuttle valve 50 into line 10 and to the compensator 3.

If the load sensed in load pressure line 10 reaches the level of the actual load pressure in the supply line 15, the connection between the line sections 9 and 10 is throttled down or fully closed, respectively. As a result, pressure in the load pressure line 10 will never exceed the actual load pressure in the supply line. For all other actuators to be operated in parallel and at lower load pressures, fluid pressure in the load pressure line 10 acts upon the spring-loaded end of the associated compensator 3 by passing across the shuttle valve 50. This pressure acts in closing direction of the compensator so as to assure the load supporting function in the event of a pressure drop in the supply line.

Figure 4:
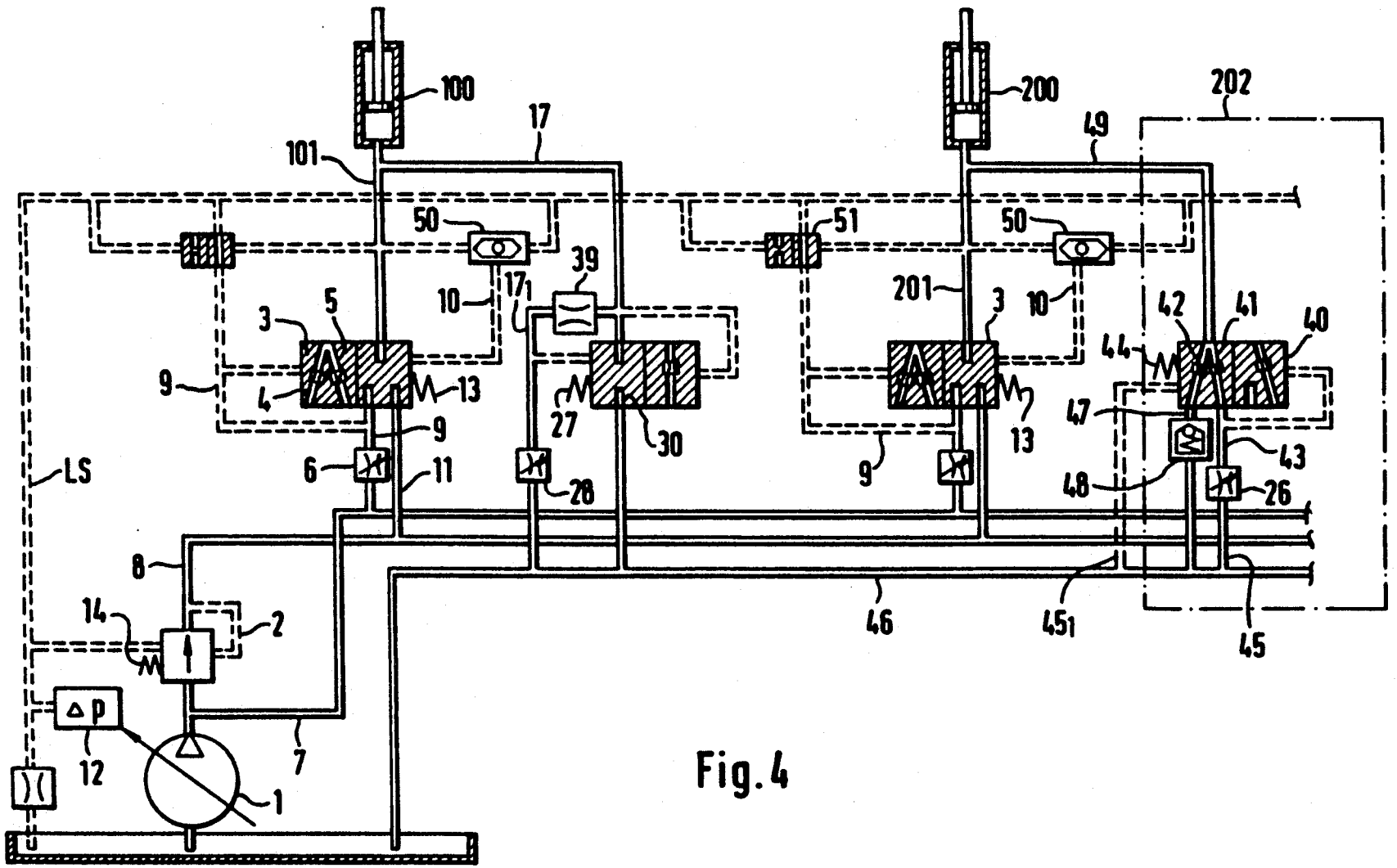
FIG. 4 shows a block diagram of a third embodiment of the invention comprising additional components for increasing and lowering loading of two single-acting actuators or consumers.

FIG. 4 shows a similar valve arrangement as FIG. 3, but comprises additional components for lifting and lowering two single-acting consumers or actuators 100, 200. The respective supply sides or circuits 101 and 201 of the valve system of FIG. 4 essentially correspond to those of FIG. 3. Accordingly, for the description of this embodiment in the region of the supply sides the same numerals are used. The arrangement in the return circuit 102 is also identical with that of FIG. 3. In this instance, too, the return line 17 includes a piloted 2-way, 2-position valve 30.

With respect to the return circuit 202 of the consumer 200 in FIG. 4, however, there is a difference to the embodiment of FIG. 3. In the valve arrangement of FIG. 3 the return circuit 202 of the consumer 200 ensures valve operation regardless of variations in load pressure by making use of an adjustable flow regulator which will now be described in greater detail.

The adjustable flow regulator consists of an adjustable throttle 26 of small nominal width or caliber (orifice area) and a compensator 40 having a control orifice 41 (metering edge) of small nominal width and a control orifice 42 (metering edge) of large nominal width. Both metering edges are interconnected, preferably by a rigid connection, the relationship between the respective cross sections being predetermined. With respect to these structural features the piston of the compensator 40 is similar in design to that of compensator 3 in the supply side or circuit. Fluid pressure in circuit section 43 downstream of the variable throttle or flowmeter 26 acts against the force of spring 44 to move the compensator into the closing position. Fluid pressure in circuit section 45 downstream of throttle 26 acts via the control line $45_1$ in the same sense as the control spring 44 in opening direction of the compensator such that upstream of the flowmeter 26 and with constant pressure in tank line 46 a pressure builds up which is higher by a rate corresponding to the force of the spring, thus keeping the volume flow rate through a given control orifice of throttle valve 26 also constant.

A main return line is designated with numeral 47 and communicates with the control orifice 42 of large nominal width. Line 47 incorporates a throttle 48 which allows the pressure in line 47 as well as in line 43 to increase when the pilot valve 26 is not actuated so as to overcome the force of the spring 44 in order to move the compensator 40 into the closing position. In this way an unwanted lowering of the load is virtually prevented.

The effect of load sensing in FIG. 4 is that the pressure $P_{49}$ in consumer port 49 by passing across the shuttle valve 50 acts upon compensator 3 in the same direction as the spring 13, i.e. to the closing position. In this instance load stabilisation is also ensured if a pressure drop in the supply circuit occurs. As in the embodiment of FIG. 3, the modified valve arrangement of FIG. 4 allows for transmission of fluid pressure in consumer port 49 to the pressure sensing valve 51 to indicate pressure in the actuator line 49, whereby the piston of pressure sensing valve is moved to the open position if the pressure in consumer port 49 tends to exceed the pressure in load sensing line LS which leads to the pump 1. In this shift position of the pressure sensing valve 51 the pressure sensed in supply line section 9 is transmitted to the load sensing line 10. Only if the measured pressure value in line 10 becomes equal to the actual load pressure in consumer port 49, fluid flow between circuit sections 9 and the load sensing line LS will be throttled down or closed. Here again, the functional performance of the device in FIG. 4 is largely similar to that of FIG. 3 so that in order to avoid duplication reference is made to the description of the operational characteristics in FIG. 3.

Figure 5:
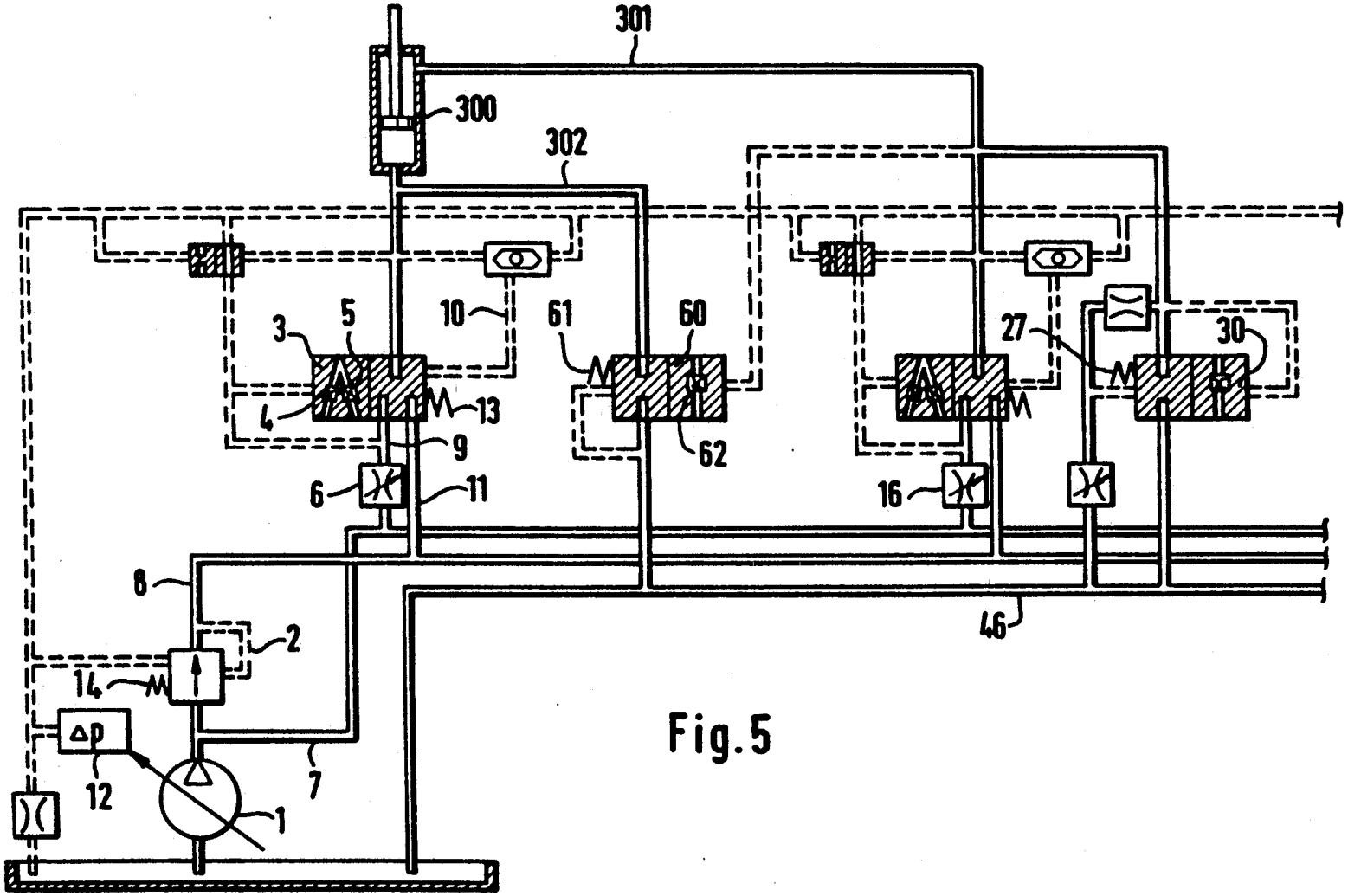
FIG. 5 is a block diagram of a fourth embodiment of the valve system according to the invention as being applied for controlling double-acting actuators or consumers.

As to the arrangement of control elements the embodiment of the valve assembly in FIG. 5 is much the same as its counterpart in FIG. 4. The peculiarity of this embodiment resides in that the device is used to control more than one double-acting consumer or actuator 300. For clarity of representation only one of such actuators is shown in FIG. 5. Again, components of comparable performance with the previous embodiment are referenced by the same numerals.

For both piston chambers of the double-acting consumer or actuator 300 in the respective supply line there is provided an adjustable flow control valve 3,6. A detailed description of the valve is omitted because it is identical to the embodiments already previously described. Where compensators are arranged at the inlet a supply side, there is always a tendency of cavitation occuring in the lowering mode of the consumer, so that the present embodiment incorporates means to allow for controlled actuation of the actuator in the direction of load while eliminating the risk of cavitation at the supply side. To achieve this there is provided in the return circuit 302 a deceleration or braking valve 60 in the form of a continously adjustable 2-way, 2-position valve. The valve piston thereof is moved to the closing position by fluid pressure in the reservoir return 46 and by a spring 61 and is acted upon in opening direction by fluid pressure in the other control chamber of the consumer 301. In operation, there is given the effect that when lowering the consumer 300 by appropriately metering the volume flow rate across the flowmeter 16, shifting of the drain orifice referenced 62 of the associated deceleration valve 60 and causing it to open is only initiated if the fluid pressure in feed line 301 is high enough to move the piston of the braking valve against the force of spring 61 and the fluid pressure in the reservoir line 46. In this way the actuator may be lowered load-independently, i.e. regardless of the load pressure, and fluid undersupply in the feed line 301 is reliably prevented which could occur if due to the action of a heavy load the return fluid flow through line 302 to the reservoir is excessive as compared with the fluid supply through the feed line 301.

Figure 6:
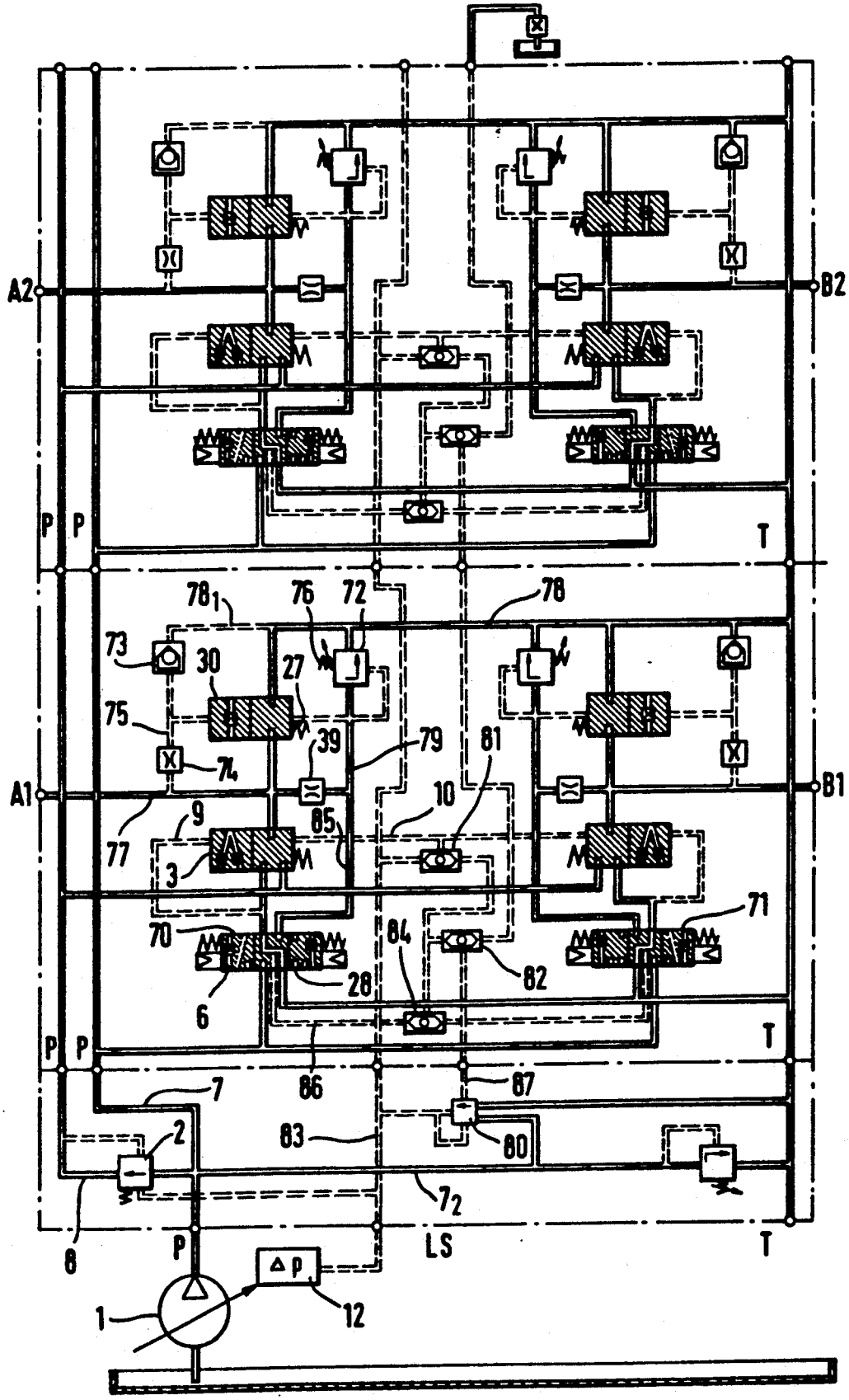
FIG. 6 is a block diagram of a fifth embodiment of the valve system using pilot valves for controlling at least two double-acting actuators.

The valve arrangement shown in FIG. 6 also performs as a control circuit of at least two double-acting consumers or actuators and is substantially akin to that of FIG. 5. Contrary to the previous embodiment each double-acting actuator is associated with two pilot valves 70 and 71 designed as 4-way, 3-position valves. Pilot valve 70 manages the flow path from P towards A and from A towards T, while pilot valve 71 controls switching of fluid from from P to B and B to T.

The volume flow rate from the consumer $A_1$ is regulated by the restrictor or flowmeter 6 and compensator 3, whereas the return flow from consumer $A_1$ is regulated regardless of load pressure, i.e. load pressure-independently in a similar manner as described with reference to FIG. 3, that is to say by means of an adjustable flow control valve 28 and a drain valve 30.

72 designates a pressure limiting or relief valve of reduced nominal width. The circuitry and arrangement is such that as pressure in the feed line to actuator $A_1$ increases to exceed the pressure limit set by the force of spring 76, the relief valve 72 opens and a certain amount of fluid from consumer or actuator line 77 is allowed to drain across restrictor 39. The resulting pressure imbalance on the drain piston of the 2-way, 2-position valve 30 then acts to open the valve and to drain fluid in excess from actuator line 77 to the reservoir line 78.

Drain valve 30 also opens each time when the force of the fluid in the reservoir line 78 exceeds the fluid pressure in actuator feed line 77 by an amount determined by the setting of spring 27. This action of valve 30 is required because in this case a non-return or check valve provided in line section $78_1$ opens to automatically cause a pressure build-up due to the throttle 74 in line section 75 so that the pressure exceeds that exerted at the closing end of the drain valve which is acted upon by the line section 79. With the arrangement shown in FIG. 6 it is possible to ensure make-up fluid supply to the consumer line 77 which helps to prevent cavitation.

Load sensing is performed as follows:

Pressure in the consumer line 77 is transmitted via line 85 to act on the pilot valve 70. Means are incorporated to ensure that on actuation of the pilot valve this load pressure is sensed and transmitted to the shuttle valve 84 and from there to the shuttle valve 82. Load pressure is then fed to a pressure reducing valve 80. At the same time the pressure at shuttle valve 82 is transmitted to the shuttle valve $8_1$ and is further directed towards the load sensing line 10 to act upon the spring side of compensator 3.

The dual function of the shuttle valve 84 is to sense the load pressure and to obstruct the drain to the tank. When operating several consumers in parallel the shuttle valve 82 transmits the respective highest load pressure sensed to the pump regulator 12. Shuttle valve $8_1$ signals load pressure of a respectively associated actuator or the load sensing line pressure LS in line 83 leading to the pump regulator 12.

From the above description it follows that the highest load pressure is transmitted and signalized to the pressure reducing valve 80 which may form part of the input element. The pressure reducing valve operates as follows:

The piston of the pressure reducing valve 80 connects the load sensing line 83 to the branch pipe $7_2$ of supply line 7 and closes the latter as the pressure in line 83 becomes equal to the pressure in line 98 which communicates with the shuttle valve 82. As a result, fluid for replenishing the sensing lines respectively associated to the pump 1 and to the various compensators in response to the actual load sensed is furnished in the moment of load sensing by the variable displacement pump 1 rather than by the load. In this way it is possible to prevent a load from falling when initiating a lifting movement of the load.

Figure 7:
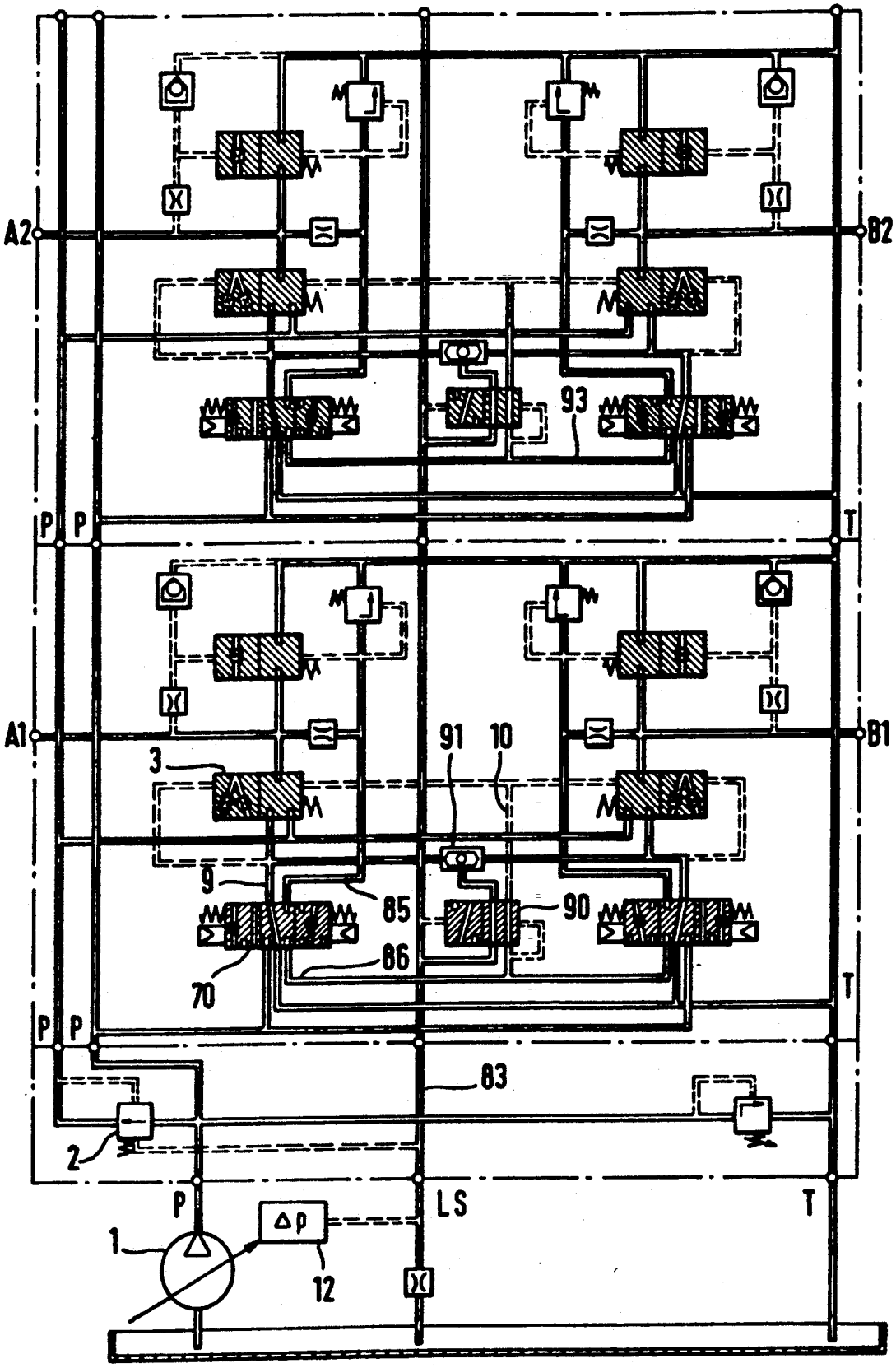
FIG. 7 shows a block diagram of a sixth embodiment of the valve system differing from the embodiment of FIG. 6 by a modification of the load sensing means.

A further embodiment of the valve arrangement finally will now be explained with reference to FIG. 7. This arrangement is largely similar to the one shown in FIG. 6, but varies with respect to the load sensing function.

In the embodiment shown, load pressure, for example, at actuator port $A_1$ on actuation of the associated pilot valve, is transmitted via line 86 to a load sensing valve 90 thereby relying on the connecting passage 86. The load sensing valve is a continuously adjustable 4-way, 2-position valve, one end of the piston being acted upon by the pressurized fluid in connecting passage 86 and the other end by the load pressure LS sensed in LS line 83. By actuating the pilot valve, load sensing valve 90 is caused to open under the action of the load pressure transmitted through the line 86, hence establishing connection to the load sensing line 10. This load sensing line 10—identical to the above described alternatives—is connected to the closing end or side of the associated compensator 3. In addition, the LS valve 90 in the open position provides a fluid pressure in the supply line 9 and the load sensing line 83 to the variable displacement pump 1. As a result replenishing fluid for the LS line 83 is again provided by the feed line 9 from the pump 1 and not from a consumer line. If the pressure $P_{83}$ in the load sensing line 83 exceeds the actual load pressure prevailing in connecting passage 86, the piston of the LS valve 90 is being displaced such as to throttle down fluid passage between the supply line 9 and the load sensing line 83 so that the resulting pressure in the LS-line 83 will always be equal to the actual load pressure.

For all other consumers each operating at lower load pressure the associated piston of the LS-valve 90 is displaced under the action of the higher fluid pressure in the LS-line 83 to a position in which lines 83 and 10 are connected to each other and the connection between the line 86 and the LS-line 10 is blocked. The spring-side control chambers of all compensators respectively associated to the consumers working under lower load are thus connected to the load sensing line 83. Only the spring-side control chamber of the compensator for the consumer with the highest load is being acted upon by the actual fluid pressure as transmitted via the lines 85 and 86.

According to the invention a valve system is provided for the load-independent control of a plurality of simultaneously operated hydraulic consumers, i.e. regardless of variations in load pressure. Fluid flow in a consumer line to each consumer passes across a compensating flow control valve, i.e. a compensator. The valve piston thereof being displaceable to the open position by a pressure downstream of a flowmeter against the opposing resistance offered by a spring and by the respective maximum load pressure of the consumers at a time. The actual highest load pressure is also available at a regulator for the common variable displacement supply pump feeding the consumers. In an attempt to ease actuation of the main valves, yet offering the capability to serve different functional requirements by slightly modifying the circuitry and to ensure that insufficient fluid supply from the pump does not exclusively affect the consumer actually subject to the maximum load, the compensator and flowmeter are arranged in a secondary flow path carrying only a fraction of the total consumer fluid supply. The main volume flow rate is regulated by the control edge of greater cross section which moves together with the pressure sensitive displacements of the compensator spool. The control edge is supplied by a valve means capable of reducing fluid pressure in a primary supply line to the pressure level downstream of the flowmeter.

What is claimed is:

1. A valve system for controlling a plurality of simultaneously actuated hydraulic consumers or actuators, in which each consumer feed line is connected across a compensating flow control valve or compensator to be opened by displacing the spool under the action of fluid pressure downstream of a flowmeter against the opposing resistance offered by a spring and the actual maximum or highest load pressure of the consumers, said highest load pressure simultaneously being transmitted to a regulating device of a variable displacement pump which supplies the consumers wherein the compensator and the flowmeter are inserted in a secondary feed line which carries a fraction of the fluid flow feed to the consumer, said fluid flow feed being regulated by a metering edge of larger cross section and adapted to participate in the control movements of the compensator, said metering edge being supplied by valve means capable of reducing the fluid pressure in the main feed line to the pressure level downstream of the flowmeter.

2. A valve system according to claim 1, wherein the valve is a pressure reducing valve carrying the volume flow rate for all consumers, said valve having a compression spring, said compression spring of the pressure reducing valve being matched to the rating of the closing spring in said compensator.

3. A valve system as in claim 2 comprising means for load-dependent controlling return fluid flow, wherein a pressure limiting valve of small nominal cross section is inserted between a spring-loaded closing end of the continuously adjustable 2-way, 2-position valve which operates as a drain valve, and a reservoir line, said pressure limiting valve being acted upon by the fluid pressure in a bypass line downstream of a fixed orifice restrictor against the force of a preferably adjustable closing spring.

4. A valve system as claimed in claim 3, wherein the reservoir line is connected to the consumer feed line via a control line which includes a non-return or check valve offering unrestricted flow to said consumer feed line, the load pressure exerted on a drain valve against the force of a closing spring is being detected between said check valve and a throttling device or throttle.

5. A valve system as claimed in claim 3, including a 4-way, 3-position valve and wherein the load pressure on actuation of said 4-way, 3-position valve is transmitted by this valve to a sensing valve in the form of a continuously adjustable 2-way, 2-position valve, which is displaceable by the actual load pressure against the pressure in a load sensing line leading to the pump regulator from a position in which the load sensing line communicates with the closing end of the compensator into a second shift position in which the load sensing line is connected to a secondary consumer feed line upstream of said compensator and in which said closing end of the compensator communicates with the load pressure carrying line.

6. A valve system as claimed in claim 1, wherein the load pressure of each one of the consumers are being transmitted each via shuttle valves arranged in a chain to the closing end or side of the respectively associated compensator.

7. A valve system as claimed in claim 1, wherein the valve means defining the flowmeter are designed to provide routing-functions exclusively by using 2-position valves with 2-way functions, said valves being preferably continuously adjustable.

8. A valve system as claimed in claim 1 and wherein a return line of at least one consumer has inserted an adjustable flow control valve comprising an adjustable flowmeter and a compensator located upstream of the flowmeter, said compensator including two parallel-disposed metering edges each one providing a different control orifice area, i.e. nominal width, at a predetermined ratio with respect to each other, the pressure between the control or metering edge of small nominal width and said adjustable flowmeter acting against the force of a regulator spring, in closing direction while fluid pressure downstream of the flowmeter acting in the same direction as the regulator spring causing the compensator to open.

9. A valve system as claimed in claim 8, wherein the control edge with larger nominal width or cross section communicates with main return line incorporating a throttle valve whereby in the closed position of the flowmeter fluid pressure buildup upstream of said throttle valve is transmitted across a control orifice of small nominal cross section to a secondary drain line leading to said adjustable flowmeter.

10. A valve system as claimed in claim 1, wherein for load depending draining of a single-acting consumer, i.e. in dependance of the load pressure, a return line is provided with a continuously adjustable 2-way, 2-position valve, the piston of said valve being biased to the open position by the load pressure in said return line against the force of a closing spring and to the closing position at the closing side by the fluid pressure in a bypass line, said pressure prevailing between a fixed orifice restrictor and a pilot valve located downstream thereof.

11. A valve system as claimed in claim 1, wherein for load-independently bleeding a double-acting consumer, i.e. regardless of load pressure, a consumer return line includes a decelerating valve acted upon in closing direction by a reservoir pressure and the force of a spring and in opening direction by the pressure exerted through the respectively opposed control chamber of the consumer.

12. A valve system as claimed in claim 11, wherein the deceleration valve is in the form of a continuously adjustable 2-way, 2-position valve.

13. A valve system as claimed in claim 1, wherein a 2-way, 2-position valve is provided to sense the load pressure and to transmit the pressure to a load sensing line leading to the variable displacement pump, said valve being acted upon at one end by the load pressure in the respectively associated consumer and at the other end by the fluid pressure in the load sensing line leading to the variable displacement pump, said valve being held in a connecting-through position permitting the fluid pressure downstream of the flowmeter to be transmitted to the load sensing line until the fluid pressure in the load sensing line leading to the variable displacement pump attains the actual load pressure.

14. A valve system as claimed in claim 13, wherein the 2-way, 2-position valve is continuously adjustable.

15. A valve system as claimed in claim 1, wherein for operating at least one double-acting consumer the flowmeter is provided in a 4-way, 3-position valve.

16. A valve system as claimed in claim 15, wherein the load pressure is transmitted or signalized on actuation of the 4-way, 3-position valve by this valve to a chain of shuttle valves which act to apply the respective sensed highest load pressure of any one of the consumers to a load sensing line leading the pump regulator.

17. A valve system as claimed in claim 16, wherein the measured highest load pressure acts upon a pressure reducing valve allowing fluid feed flow from the consumer feed line to pass to the load sensing line whenever fluid pressure in the load sensing line falls below the actual load pressure, until the pressure in said load sensing line has reached the actual load pressure.

* * * * *